US009842528B2

(12) United States Patent
Tseng et al.

(10) Patent No.: US 9,842,528 B2
(45) Date of Patent: *Dec. 12, 2017

(54) DRIVING DEVICE

(71) Applicant: Novatek Microelectronics Corp., Hsinchu (TW)

(72) Inventors: Po-Yu Tseng, Taoyuan (TW); Jhih-Siou Cheng, New Taipei (TW); Pang-Chen Hung, Hsinchu County (TW)

(73) Assignee: Novatek Microelectronics Corp., Hsinchu (TW)

( * ) Notice: Subject to any disclaimer, the term of this patent is extended or adjusted under 35 U.S.C. 154(b) by 0 days.

This patent is subject to a terminal disclaimer.

(21) Appl. No.: 15/256,753

(22) Filed: Sep. 6, 2016

(65) Prior Publication Data

US 2016/0372018 A1 Dec. 22, 2016

Related U.S. Application Data

(63) Continuation-in-part of application No. 14/534,167, filed on Nov. 6, 2014, now Pat. No. 9,536,462.

(30) Foreign Application Priority Data

Sep. 15, 2014 (CN) ..... 2014 1 0469946

(51) Int. Cl.
*G09G 3/3275* (2016.01)
*G09G 3/20* (2006.01)

(52) U.S. Cl.
CPC ..... *G09G 3/20* (2013.01); *G09G 2310/027* (2013.01); *G09G 2310/0289* (2013.01); *G09G 2330/025* (2013.01); *G09G 2330/045* (2013.01)

(58) Field of Classification Search
CPC ..... G09G 3/20; G09G 2310/0289; G09G 2330/045; G09G 2330/025; G09G 2310/027; G09G 3/3275
See application file for complete search history.

(56) References Cited

U.S. PATENT DOCUMENTS

2009/0009453 A1* 1/2009 Furihata ..... G09G 3/3685 345/87
2009/0295777 A1* 12/2009 Wang ..... G09G 3/3614 345/212

* cited by examiner

*Primary Examiner* — Premal Patel
(74) *Attorney, Agent, or Firm* — JCIPRNET

(57) ABSTRACT

A driving device is provided. The driving device includes a first code mapping circuit, a first source driving channel, a second code mapping circuit and a second source driving channel. The first code mapping circuit converts a first input code in input data into a first intermediate code according to a first code-to-code mapping relation. The first source driving channel converts the first intermediate code into a first analog voltage according to a first code-to-voltage mapping relation. The second code mapping circuit converts a second input code in the input data into a second intennediate code according to a second code-to-code mapping relation which is different from the first code-to-code mapping relation. The second source driving channel converts the second intermediate code into a second analog voltage according to a second code-to-voltage mapping relation which is different from the first code-to-voltage mapping relation.

9 Claims, 9 Drawing Sheets

DRIVING DEVICE

CROSS-REFERENCE TO RELATED APPLICATION

This application is a continuation-in-part application of and claims the priority benefit of a prior application Ser. No. 14/534,167, filed on Nov. 6, 2014, now pending. The prior application Ser. No. 14/534,167 claims the priority benefit of China application serial no. 201410469946.2, filed on Sep. 15, 2014. The entirety of each of the above-mentioned patent applications is hereby incorporated by reference herein and made a part of this specification.

BACKGROUND OF THE INVENTION

Field of the Invention

The invention relates to a display, and more particularly, relates to a driving device.

Description of Related Art

In a traditional panel driving chip, an input signal of a source driving channel is identical to an input signal of a level shifter therein. For example, if the input signal of one specific source driving channel is "00000000", this 8-bit data "00000000" is transmitted faithfully to an input terminal of the level shifter inside that specific source driving channel. In the traditional panel driving chip, all the source driving channels transmits the input signal thereof faithfully to the input terminal of the level shifter therein by such manner. When the driving chip outputs a specific frame, the level shifters in multiple sets of the source driving channels simultaneously switch the output signal, resulting in a large number of instantaneous currents. For instance, when all pixel data in one frame are converted from "00000000" into "11111111", the level shifters in all the source driving channels are required to simultaneously convert 8 bits from 0 to 1, which leads to the large number of instantaneous currents. The large number of instantaneous currents induces problems such as rise in temperature, voltage disturbance, and so on, and said problems may change the characteristics of the chip as well as reducing a reliability of the chip.

SUMMARY OF THE INVENTION

The invention is directed to a driving device, which are capable of effectively preventing the large number of instantaneous currents simultaneously occurred on the level shifters inside all the source driving channels, so as to achieve the effectiveness of reducing temperature and enhancing the reliability of the chip.

A driving device is provided according to an embodiment of the invention, and the driving device includes a first code mapping circuit, a first source driving channel, a second code mapping circuit and a second source driving channel. The first code mapping circuit converts a first input code in input data into a first intermediate code according to a first code-to-code mapping relation. The first source driving channel is coupled to the first code mapping circuit. The first source driving channel receives the first intermediate code, and converts the first intermediate code into a first analog voltage according to a first code-to-voltage mapping relation. The second code mapping circuit converts a second input code in the input data into a second intermediate code according to a second code-to-code mapping relation which is different from the first code-to-code mapping relation. The second source driving channel is coupled to the second code mapping circuit. The second source driving channel receives the second intermediate code, and converts the second intermediate code into a second analog voltage according to a second code-to-voltage mapping relation which is different from the first code-to-voltage mapping relation.

Based on the above, by providing different code-to-code mapping relations for different source driving channels, the driving device according to the embodiments of the invention are capable of effectively preventing the large number of instantaneous currents simultaneously occurred on the level shifters inside all the source driving channels, so as to achieve the effectiveness of reducing temperature and enhancing the reliability of the chip.

To make the above features and advantages of the invention more comprehensible, several embodiments accompanied with drawings are described in detail as follows.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
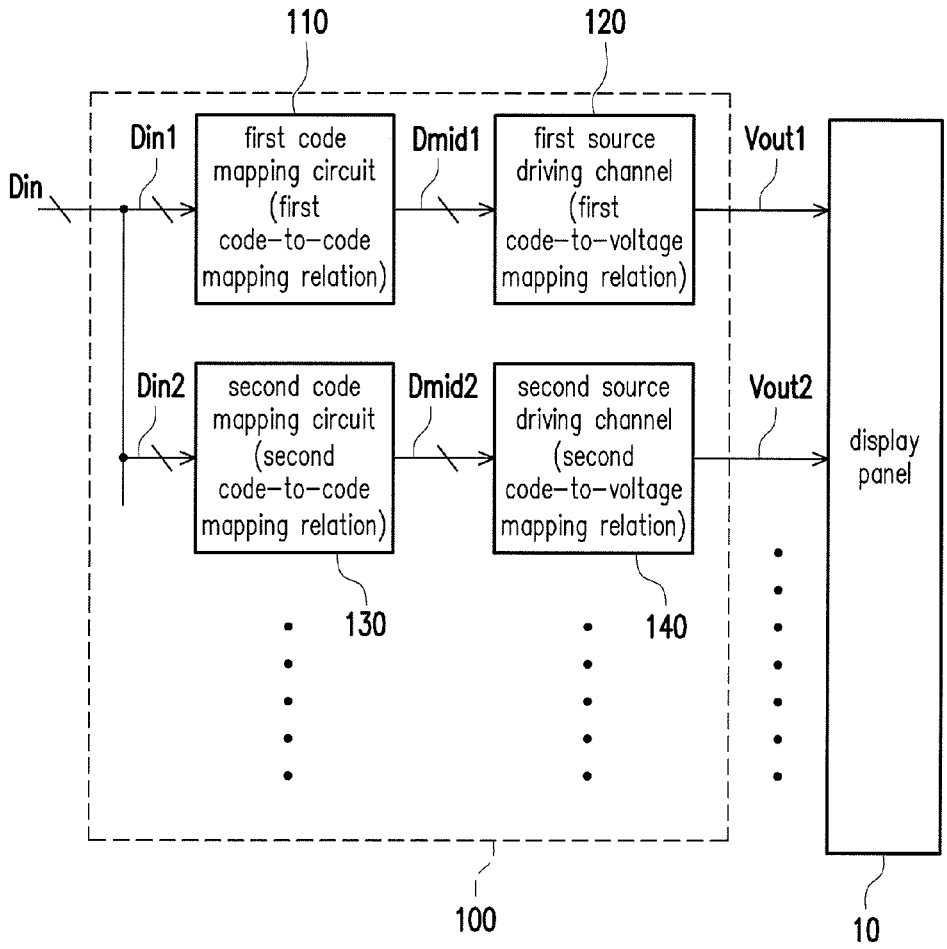
FIG. 1 is a block diagram illustrating circuitry of a driving device according to an embodiment of the invention.

Reference will now be made in detail to the present preferred embodiments of the invention, examples of which are illustrated in the accompanying drawings. Wherever possible, the same reference numbers are used in the drawings and the description to refer to the same or like parts.

The term "coupling/coupled" used in this specification (including claims) may refer to any direct or indirect connection means. For example, "a first device is coupled to a second device" should be interpreted as "the first device is directly connected to the second device" or "the first device is indirectly connected to the second device through other devices or connection means." Moreover, elements/components/steps with same reference numerals represent same or similar parts in the drawings and embodiments. Elements/components/steps with the same reference numerals or names in different embodiments may be cross-referenced.

FIG. 1 is a block diagram illustrating circuitry of a driving device according to an embodiment of the invention. A driving device 100 includes a plurality of code mapping circuits (e.g., a first code mapping circuit 110 and a second code mapping circuit 130) and a plurality of source driving channels (e.g., a first source driving channel 120 and a second source driving channel 140). The first code mapping circuit 110 converts a first input code Din1 in input data Din into a first intermediate code Dmid1 according to a first code-to-code mapping relation. The first source driving channel 120 is coupled to the first code mapping circuit 110. The first source driving channel 120 receives the first intermediate code Dmid1, and converts the first intermediate code Dmid1 into a first analog voltage Vout1 according to a first code-to-voltage mapping relation. The first source driving channel 120 outputs the first analog voltage Vout1 to a data line (source line) of a display panel 10 in order to drive the display panel 10. According to a second code-to-code mapping relation which is different from the first code-to-code mapping relation, the second code mapping circuit 130 converts a second input code Din2 in the input data Din into a second intermediate code Dmid2. The second source driving channel 140 is coupled to the second code mapping circuit 130 in order to receive the second intermediate code Dmid2. According to a second code-to-voltage mapping relation which is different from the first code-to-voltage mapping relation, the second source driving channel 140 converts the second intermediate code Dmid2 into a second analog voltage Vout2. The second source driving channel 140 outputs the second analog voltage Vout2 to another data line of the display panel 10 in order to drive the display panel 10.

The first code mapping circuit 110 and the second code mapping circuit 130 can be implemented with any type of hardware. For example, in some embodiments, a look-up table can be configured into the code mapping circuit 110 (or 130), so as to record the code-to-code mapping relation. The first code mapping circuit 110 can use the look-up table to convert the first input code Din1 in input data Din into a first intermediate code Dmid1. The second code mapping circuit 130 can use the look-up table to convert the second input code Din2 in the input data Din into a second intermediate code Dmid2.

In other embodiments, a logic circuit (or a conversion circuit) can be configured into the code mapping circuit 110 (or 130), so as to perform a conversion operation according to the code-to-code mapping relation. The logic circuit (or the conversion circuit) in the code mapping circuit 110 (or 130) may be a conventional logic circuit or other logic circuit. For example, the logic circuit (or the conversion circuit) in the code mapping circuit 110 (or 130) may be a non-volatile memory (NVM), programmable logic device (PLD), complex programmable logic device (CPLD), field programmable gate array (FPGA) or other logic circuit. The first code mapping circuit 110 can use the logic circuit (or the conversion circuit) to convert the first input code Din1 in input data Din into a first intermediate code Dmid1. The second code mapping circuit 130 can use the logic circuit (or the conversion circuit) to convert the second input code Din2 in the input data Din into a second intermediate code Dmid2.

For instance, it is assumed that the driving device 100 is capable of converting an input code "00000000" into an analog voltage Va, and converting an input code "11111111" into an analog voltage Vb. When the first input code Din1 and the second input code Din2 are both "00000000", the first code mapping circuit 110 is capable of converting "00000000" into "00000000" (the first intermediate code Dmid1) according to the first code-to-code mapping relation, and the second code mapping circuit 130 is capable of converting "00000000" into "00111000" (the second intermediate code Dmid2) according to the second code-to-code mapping relation. The first source driving channel 120 is capable of converting "00000000" into the analog voltage Va (the first analog voltage Vout1) according to the first code-to-voltage mapping relation, and the second source driving channel 140 is capable of converting "00111000" into the analog voltage Va (the second analog voltage Vout2) according to the second code-to-voltage mapping relation. After the first input code Din1 and the second input code Din2 both transition from "00000000" to "11111111", the first code mapping circuit 110 is capable of converting "11111111" into "11111111" (the first intermediate code Dmid1) according to the first code-to-code mapping relation, and the second code mapping circuit 130 is capable of converting "11111111" into "00111111" (the second intermediate code Dmid2) according to the second code-to-code mapping relation. The first source driving channel 120 is capable of converting "11111111" into the analog voltage Vb (the first analog voltage Vout1) according to the first code-to-voltage mapping relation, and the second source driving channel 140 is capable of converting "001111111" into the analog voltage Vb (the second analog voltage Vout2) according to the second code-to-voltage mapping relation. Therefore, when the first input code Din1 transitions from "00000000" to "11111111", a number of transitional bits in the digital data of the first source driving channel 120 is 8 bits (because it is converted from "00000000" into "11111111"). When the second input code Din2 transitions from "00000000" to "11111111", a number of transitional bits in the digital data of the second source driving channel 140 is 3 bits (because it is converted from "00111000" into "00111111"). When the first input code Din1 and the second input code Din2 both transition from "00000000" to "11111111", an average number of the transitional bits in the digital data of the first source driving channel 120 and the second source driving channel 140 is (8+3)/2=5.5 bits.

By providing different code-to-code mapping relations for different source driving channels, the driving device 100 of the present embodiment is capable of effectively reducing the average number of the transitional bits in the digital data of the source driving channels. As a result, the large number of instantaneous currents simultaneously occurred on the level shifters inside all the source driving channels may be effectively prevent, so as to achieve the effectiveness of reducing temperature and enhancing the reliability of the chip.

A source driving method is described below. The source driving method includes the followings. First, a first input code Din1 in input data Din is converted into a first intermediate code Dmid1 according to a first code-to-code mapping relation. Next, the first intermediate code Dmid1 is converted into a first analog voltage Vout1 according to a first code-to-voltage mapping relation, and the first analog voltage Vout1 is configured to generate a first source driving signal in order to drive a display panel 10. Then, a second input code Din2 in the input data Din is converted into a second intermediate code Dmid2 according to a second code-to-code mapping relation which is different from the first code-to-code mapping relation. Subsequently, the second intermediate code Dmid2 is converted into a second analog voltage Vout2 according to a second code-to-voltage mapping relation which is different from the first code-to-voltage mapping relation, and the second analog voltage Vout2 is configured to generate a second source driving signal in order to drive the display panel 10.

Figure 2:
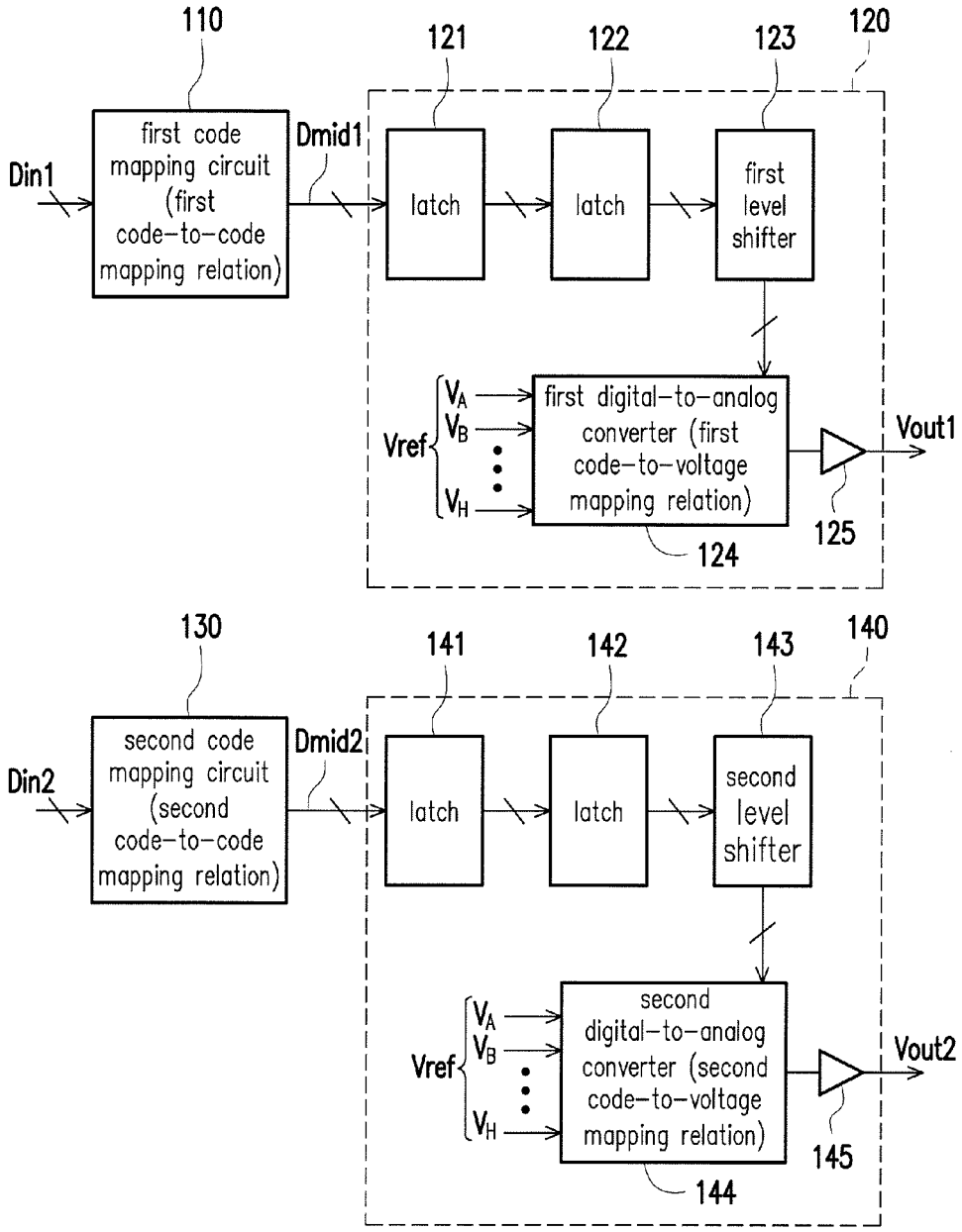
FIG. 2 is a block diagram illustrating circuitry of the driving device depicted in FIG. 1 according to an embodiment of the invention.

FIG. 2 is a block diagram illustrating circuitry of the driving device depicted in FIG. 1 according to an embodiment of the invention. Although FIG. 2 merely illustrates two of the source driving channels of the driving device 100, the rest of the source driving channels of the driving device 100 may be deduced with reference to FIG. 2, and thus related description thereof is omitted hereinafter. Referring to FIG. 2, the first source driving channel 120 includes at least two first latches (e.g., latches 121 and 122), a first level shifter 123, a first digital-to-analog converter (DAC) 124 and an output buffer 125. The latches 121 and 122 are coupled between the first code mapping circuit 110 and the first level shifter 123. The latches 121 and 122 are capable of latching the first inteiinediate code Dmid1, and outputting the latched first intermediate code Dmid1 to the first level shifter 123. The first level shifter 123 generates a first level-shifted code to the first DAC 124 according to the first intermediate code Dmid1. The first DAC 124 receives a plurality of reference voltages Vref. A first routing path is included inside the first DAC 124, and the first routing path is corresponding to the first code-to-voltage mapping relation. According to the first code-to-voltage mapping relation, the first DAC 124 is capable of converting the first level-shifted code outputted by the first level shifter 123 into a corresponding reference voltage among the plurality of reference voltages Vref to serve as the first analog voltage Vout1. The output buffer 125 is capable of gaining the first analog voltage Vout1 outputted by the first DAC 124, and outputting the gained first analog voltage Vout1 to the display panel 10.

Similarly, the second source driving channel 140 includes at least two second latches (e.g., latches 141 and 142), a second level shifter 143, a second DAC 144 and an output buffer 145. The latches 141 and 142 are coupled between the second code mapping circuit 130 and the second level shifter 143. The latches 141 and 142 are capable of latching the second intermediate code Dmid2, and outputting the latched second intermediate code Dmid2 to the second level shifter 143. The second level shifter 143 generates a second level-shifted code to the second DAC 144 according to the second intermediate code Dmid2. The second DAC 144 receives a plurality of reference voltages Vref. A second routing path is included inside the second DAC 144, and the second routing path is corresponding to the second code-to-voltage mapping relation. According to the second code-to-voltage mapping relation, the second DAC 144 is capable of converting the second level-shifted code outputted by the second level shifter 143 into a corresponding reference voltage among the plurality of reference voltages Vref to serve as the second analog voltage Vout2.

Figure 3:
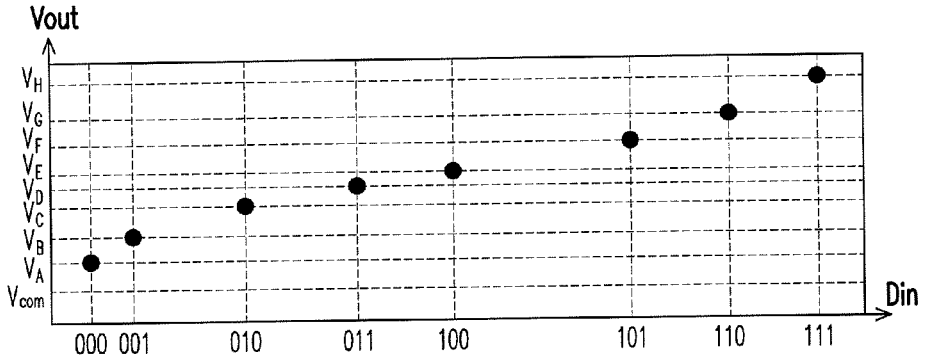
FIG. 3 is a schematic curve diagram illustrating a relation between input data and an output analog voltage of the driving device according to the embodiments of the invention.
Figure 4A:
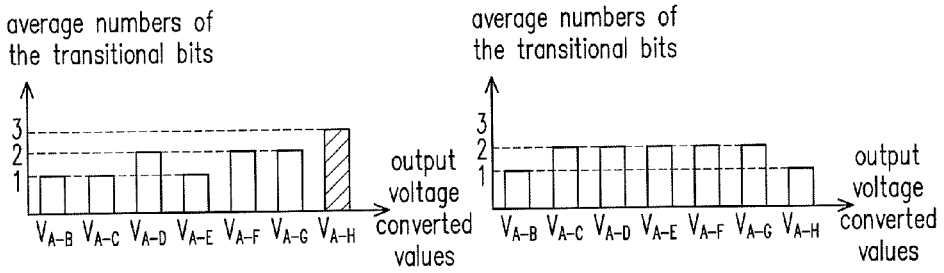
FIG. 4A to FIG. 4H illustrate average numbers of transitional bits in digital data of the level shifter in different voltage transitions.
Figure 4B:
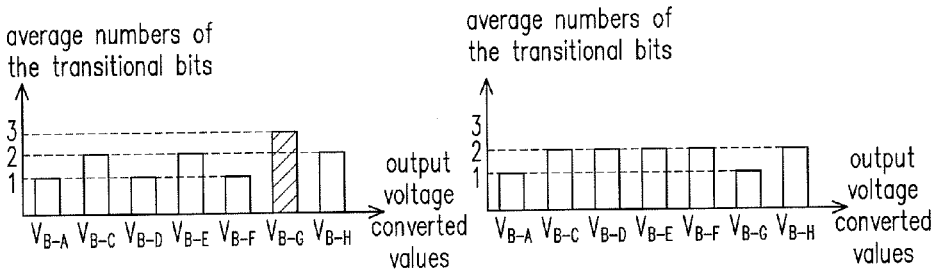
Figure 4C:
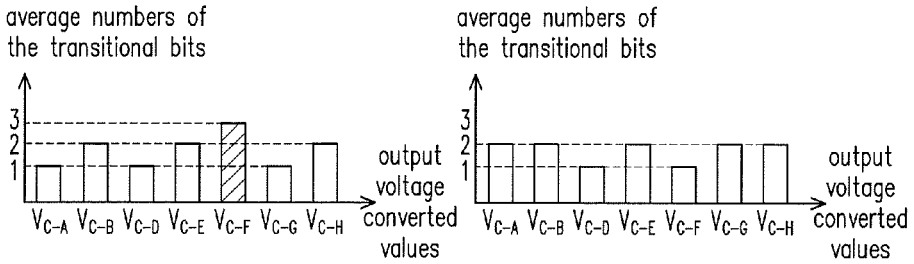
Figure 4D:
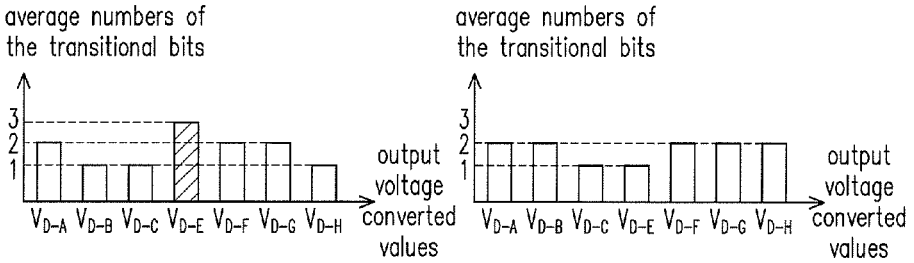
Figure 4E:
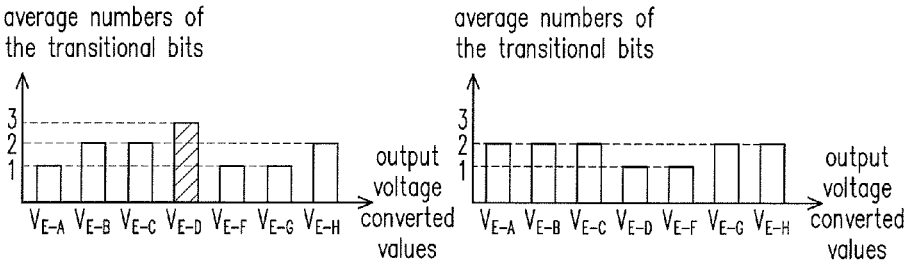
Figure 4F:
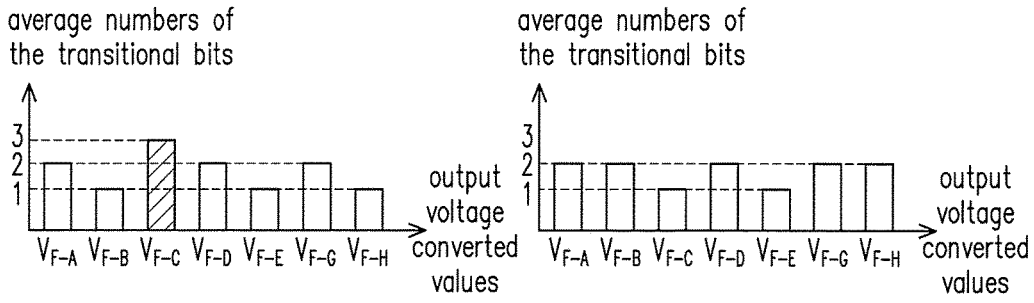
Figure 4G:
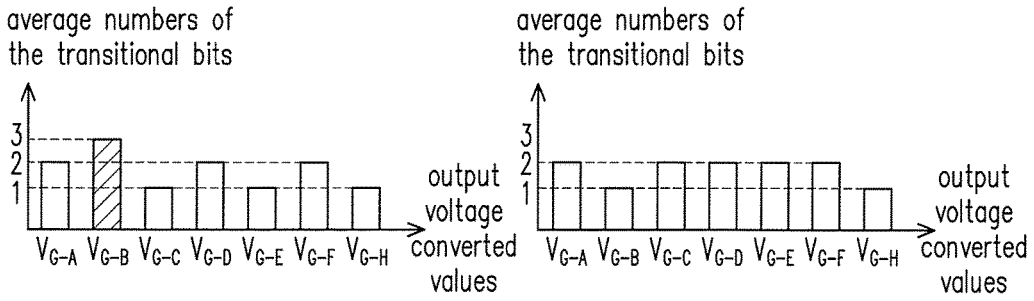
Figure 4H:
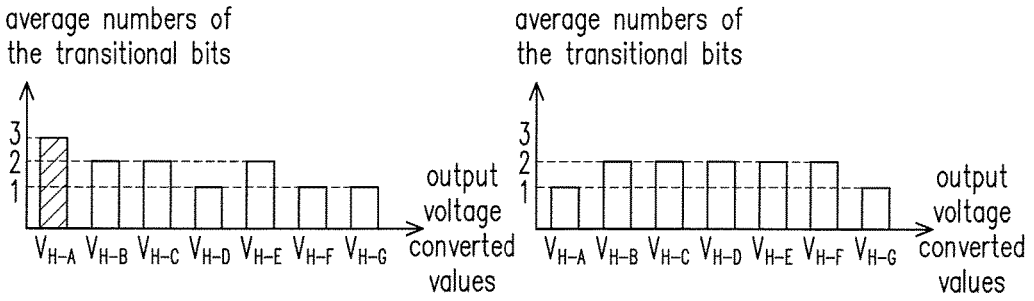

For instance, in the present embodiment, it is assumed that the first input code Din1 and the second input code Din2 are both of a 3-bit data. In other embodiments, the first input code Din1 and the second input code Din2 may also be of a 6-bit data, a 7-bit data, a 8-bit data or other data. FIG. 3 is a schematic curve diagram illustrating a relation between input data Din (e.g., the first input code Din1 or the second input code Din2) and an output analog voltage Vout (e.g., the first analog voltage Vout1 or the second analog voltage Vout2) of the driving device according to the embodiments of the invention. A horizontal axis depicted in FIG. 3 represents the input data Din, and a vertical axis depicted in FIG. 3 represents the output analog voltage Vout. Vcom depicted in FIG. 3 represents a common voltage of the display panel 10. In view of FIG. 3, when the input data Din (e.g., the first input code Din1 or the second input code Din2) is "000", "001", "010", "011", "100", "101", "110" and "111", the output analog voltage Vout (e.g., the first analog voltage Vout1 or the second analog voltage Vout2) of the driving device 100 is "$V_A$", "$V_B$", "$V_C$", "$V_D$", "$V_E$", "$V_F$", "$V_G$" and "$V_H$" respectively.

Table 1 below is an exemplary example illustrating the first code-to-code mapping relation and the first code-to-voltage mapping relation, and Table 2 below is an exemplary example illustrating the second code-to-code mapping relation and the second code-to-voltage mapping relation. For example, when the first input code Din1 and the second input code Din2 are both "010", the first code mapping circuit 110 is capable of converting "010" into "010" (the first intermediate code Dmid1) according to the first code-to-code mapping relation, and the second code mapping circuit 130 is capable of converting "010" into "111" (the second intermediate code Dmid2) according to the second code-to-code mapping relation. The first source driving channel 120 is capable of converting "010" into the analog voltage $V_C$ (the first analog voltage Vout1) according to the first code-to-voltage mapping relation, and the second source driving channel 140 is capable of converting "111" into the analog voltage Vc (the second analog voltage Vout2) according to the second code-to-voltage mapping relation. However, in other embodiments, implementations for the first code-to-code mapping relation, the second code-to-code mapping relation, the first code-to-voltage mapping relation and the second code-to-voltage mapping relation should not be restricted by the contents as shown in Table 1 and Table 2.

TABLE 1 the exemplary example of the first code-to-code mapping relation and the first code-to-voltage mapping relation

| First code-to-code mapping relation | | First code-to-voltage mapping relation | |
|---|---|---|---|
| First input code Din1 | First intermediate code Dmid1 | First intermediate code Dmid1 | First analog voltage Vout1 |
| 000 | 000 | 000 | $V_A$ |
| 001 | 001 | 001 | $V_B$ |
| 010 | 010 | 010 | $V_C$ |
| 011 | 011 | 011 | $V_D$ |
| 100 | 111 | 111 | $V_E$ |
| 101 | 110 | 110 | $V_F$ |
| 110 | 101 | 101 | $V_G$ |
| 111 | 100 | 100 | $V_H$ |

TABLE 2 the exemplary example of the second code-to-code mapping relation and the second code-to-voltage mapping relation

| Second code-to-code mapping relation | | Second code-to-voltage mapping relation | |
|---|---|---|---|
| Second input code Din2 | Second intermediate code Dmid2 | Second intermediate code Dmid2 | Second analog voltage Vout2 |
| 000 | 000 | 000 | $V_A$ |
| 001 | 001 | 001 | $V_B$ |
| 010 | 111 | 111 | $V_C$ |
| 011 | 110 | 110 | $V_D$ |
| 100 | 010 | 010 | $V_E$ |
| 101 | 011 | 011 | $V_F$ |
| 110 | 101 | 101 | $V_G$ |
| 111 | 100 | 100 | $V_H$ |

When the first input code Din1 and the second input code Din2 both transition from "000" to "010", the first intermediate code Dmid1 transitions from "000" to "010", and the second intermediate code Dmid2 transitions from "000" to "111". Therefore, a number of transitional bits in the digital data of the first level shifter 123 is 1 bit (because it is converted from "000" into "010"), and a number of transitional bits in the digital data of the second level shifter 143 is 3 bits (because it is converted from "000" into "111"). In other words, when the first input code Din1 and the second input code Din2 both transition from "000" to "010", an average number of the transitional bits in the digital data of the first level shifter 123 and the second level shifter 143 is (1+3)/2=2 bits.

When the first input code Din1 and the second input code Din2 both transition from "000" to "111", the first intermediate code Dmid1 and the second intermediate code Dmid2 both transition from "000" to "100". Therefore, the numbers of the transitional bits in the digital data of the first level shifter 123 and the second level shifter 143 are both 1 bit (because it is converted from "000" into "100"). In other words, when the first input code Din1 and the second input code Din2 both transition from "000" to "111", an average number of the transitional bits in the digital data of the first level shifter 123 and the second level shifter 143 is (2+2)/2=2 bits.

Hereinafter, it is assumed that, transitions of the output analog voltage Vout (e.g., the first analog voltage Vout1 or the second analog voltage Vout2) from $V_A$ to $V_B$, $V_C$, $V_D$, $V_E$, $V_F$, $V_G$ and $V_H$ are represented by $V_{A-B}$, $V_{A-C}$, $V_{A-D}$, $V_{A-E}$, $V_{A-F}$, $V_{A-G}$ and $V_{A-H}$ respectively; transitions of the output analog voltage Vout from $V_B$ to $V_A$, $V_C$, $V_D$, $V_E$, $V_F$, $V_G$ and $V_H$ are represented by $V_{B-A}$, $V_{B-C}$, $V_{B-D}$, $V_{B-E}$, $V_{B-F}$, $V_{B-G}$ and $V_{B-H}$ respectively; transitions of the output analog voltage Vout from $V_C$ to $V_A$, $V_B$, $V_D$, $V_E$, $V_F$, $V_G$ and $V_H$ are represented by $V_{C-A}$, $V_{C-B}$, $V_{C-D}$, $V_{C-E}$, $V_{C-F}$, $V_{C-G}$ and $V_{C-H}$ respectively; transitions of the output analog voltage Vout from $V_D$ to $V_A$, $V_B$, $V_C$, $V_E$, $V_F$, $V_G$ and VH are represented by $V_{D-A}$, $V_{D-B}$, $V_{D-C}$, $V_{D-E}$, $V_{D-F}$, $V_{D-G}$ and $V_{D-H}$ respectively; transitions of the output analog voltage Vout from $V_E$ to $V_A$, $V_B$, $V_C$, $V_D$, $V_F$, $V_G$ and $V_H$ are represented by $V_{E-A}$, $V_{E-B}$, $V_{E-C}$, $V_{E-D}$, $V_{E-F}$, $V_{E-G}$ and $V_{E-H}$ respectively; transitions of the output analog voltage Vout from $V_F$ to $V_A$, $V_B$, $V_C$, $V_D$, $V_E$, $V_G$ and $V_H$ are represented by $V_{F-A}$, $V_{F-B}$, $V_{F-C}$, $V_{F-D}$, $V_{F-E}$, $V_{F-G}$ and $V_{F-H}$ respectively; transitions of the output analog voltage Vout from $V_G$ to $V_A$, $V_B$, $V_C$, $V_D$, $V_E$, $V_F$ and $V_H$ are represented by $V_{G-A}$, $V_{G-B}$, $V_{G-C}$, $V_{G-D}$, $V_{G-E}$, $V_{G-F}$ and $V_{G-H}$ respectively; and transitions of the output analog voltage Vout from $V_H$ to $V_A$, $V_B$, $V_C$, $V_D$, $V_E$, $V_F$ and $V_G$ are represented by $V_{H-A}$, $V_{H-B}$, $V_{H-C}$, $V_{H-D}$, $V_{H-E}$, $V_{H-F}$ and $V_{H-G}$ respectively. With respect to the voltage transitions $V_{A-C}$ and $V_{A-H}$, related description for the average numbers of the transitional bits in the digital data of the level shifters of different source driving channels has been described in the previous two paragraphs. As for the rest of the voltage transitions, the average numbers of the transitional bits in the digital data of the level shifters of different source driving channels may be deduced from the related description for the voltage transitions $V_{A-C}$ and $V_{A-H}$, which is not repeated hereinafter.

FIG. 4A to FIG. 4H illustrate average numbers of transitional bits in digital data of the level shifter in different voltage transitions. Among them, a horizontal axis represents the different voltage transitions (e.g., $V_{A-H}$ represents the transition of the output analog voltage Vout from $V_A$ to $V_H$) and a vertical axis represents the average numbers of the transitional bits. Right half portions of FIG. 4A to FIG. 4H serve to illustrate the average numbers of the transitional bits in the digital data of the level shifters 123 and 143 under the different voltage transitions according to the embodiment in which the different code-to-code mapping relations and the different code-to-voltage mapping relations (e.g., the examples shown in Table 1 and Table 2) are used by the different source driving channels of the source driver depicted in FIG. 2. Left half portions of FIG. 4A to FIG. 4H serve to illustrate the average numbers of the transitional bits in the digital data of the level shifters 123 and 143 under the different voltage transitions according to the embodiment in which the same code-to-code mapping relation and the same code-to-voltage mapping relation (i.e., as shown in Table 3) are used by all the source driving channels of the source driver depicted in FIG. 2. In view of FIG. 4A to FIG. 4H, as compared to "all the source driving channels use the same mapping relation", "the different source driving channels use the different mapping relations" is capable of effectively reducing the average number of the transitional bits in the digital data of the level shifters, so as to achieve the effectiveness of reducing the instantaneous energy. By providing different code-to-code mapping relations for different source driving channels, the driving device 100 of the present embodiment is capable of effectively reducing the average number of the transitional bits in the digital data of the source driving channels. As a result, the large number of instantaneous currents simultaneously occurred on the level shifters inside all the source driving channels may be effectively prevent, so as to achieve the effectiveness of reducing temperature and enhancing the reliability of the chip.

TABLE 3 the exemplary example of the same code-to-code mapping relation and the same code-to-voltage mapping relation used by all the source driving channels

| Code-to-code mapping relation | | Code-to-voltage mapping relation | |
|---|---|---|---|
| Input code | Intermediate code | Intermediate code | Analog voltage |
| 000 | 000 | 000 | $V_A$ |
| 001 | 001 | 001 | $V_B$ |
| 010 | 010 | 010 | $V_C$ |
| 011 | 011 | 011 | $V_D$ |
| 100 | 100 | 100 | $V_E$ |
| 101 | 101 | 101 | $V_F$ |
| 110 | 110 | 110 | $V_G$ |
| 111 | 111 | 111 | $V_H$ |

Figure 5:
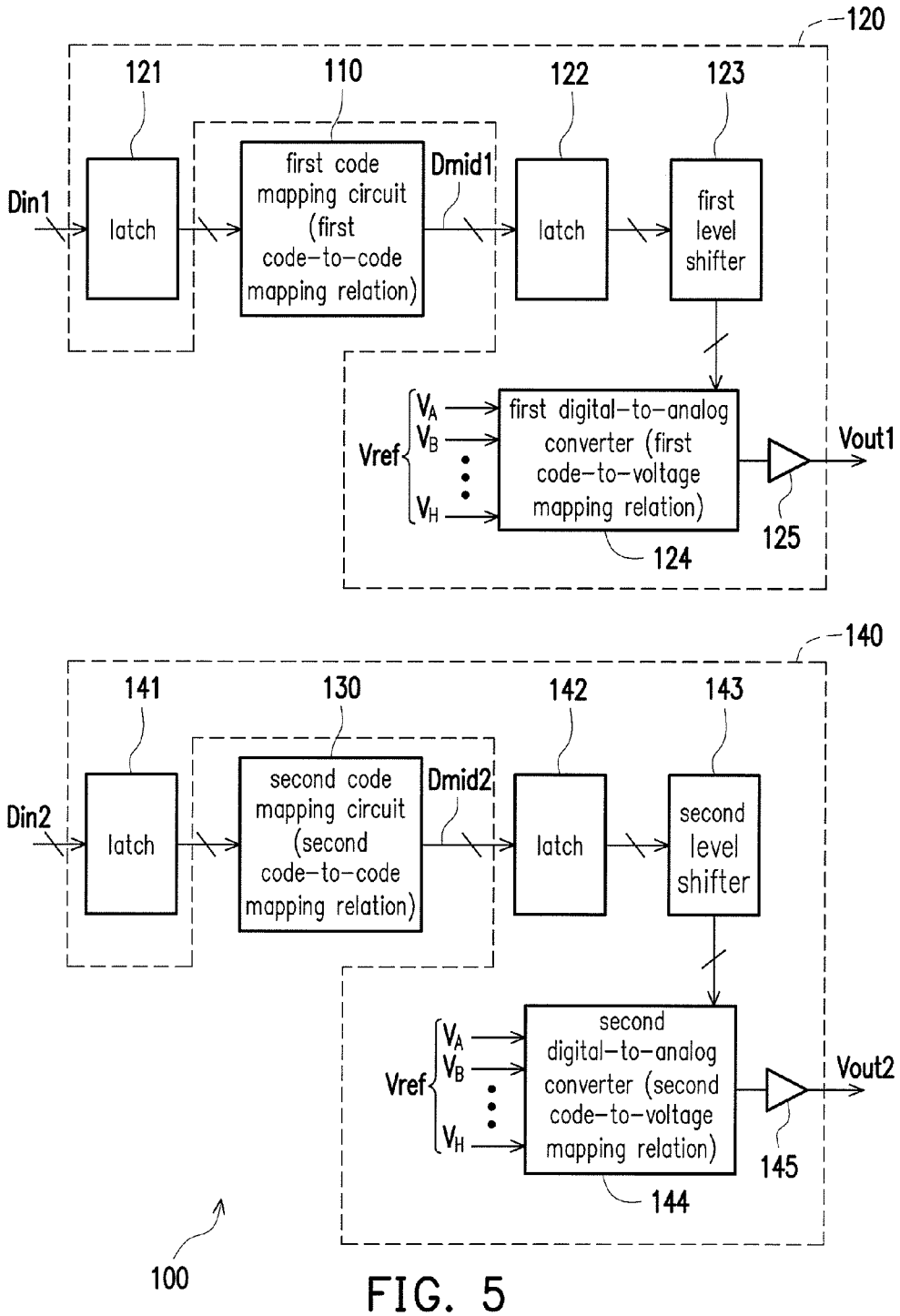
FIG. 5 is a block diagram illustrating circuitry of the driving device depicted in FIG. 1 according to another embodiment of the invention.

FIG. 5 is a block diagram illustrating circuitry of the driving device depicted in FIG. 1 according to another embodiment of the invention. Although FIG. 5 merely illustrates two of the source driving channels of the driving device 100, the rest of the source driving channels of the driving device 100 may be deduced with reference to FIG. 5, and thus related description thereof is omitted hereinafter. Referring to FIG. 5, the first source driving channel 120 includes two first latches (e.g., latches 121 and 122), a first level shifter 123, a first DAC 124 and an output buffer 125. The second source driving channel 140 includes two second latches (e.g., latches 141 and 142), a second level shifter 143, a second DAC 144 and an output buffer 145. The first source driving channel 120 and the second source driving channel 140 as depicted in FIG. 5 may refer to the related description for FIG. 2, which is not repeated hereinafter. In the embodiment depicted in FIG. 5, the first code mapping circuit 110 is coupled between the latch 121 and the latch 122, and the second code mapping circuit 130 is coupled between the latch 141 and the latch 142.

The latch 121 is capable of latching the first input code Din1 in the digital data Din, and outputting the latched first input code Din1 to the first code mapping circuit 110. The first code mapping circuit 110 converts the first input code Din1 into the first intermediate code Dmid1 according to a first code-to-code mapping relation, and outputs the first intermediate code Dmid1 to the latch 122. The latch 122 is capable of latching the first intermediate code Dmid1, and outputting the latched first intermediate code Dmid1 to the first level shifter 123. The first level shifter 123 generates a first level-shifted code to the first DAC 124 according to the first intermediate code Dmid1. According to the first code-to-voltage mapping relation, the first DAC 124 is capable of converting the first level-shifted code outputted by the first level shifter 123 into a corresponding reference voltage among the plurality of reference voltages Vref to serve as the first analog voltage Vout1. The first code-to-code mapping relation of the first code mapping circuit 110 and the first code-to-voltage mapping relation of the first DAC 124 may refer to related description for Table 1 above (but the invention is not limited thereto).

Similarly, the latch 141 is capable of latching the second input code Din2 in the digital data Din, and outputting the latched second input code Din2 to the second code mapping circuit 130. The seconds code mapping circuit 130 converts the second input code Din2 into the second intermediate code Dmid2 according to a second code-to-code mapping relation, and outputs the second intermediate code Dmid2 to the latch 142. The latches 142 is capable of latching the second intermediate code Dmid2, and outputting the latched second intermediate code Dmid2 to the second level shifter 143. The second level shifter 143 generates a second level-shifted code to the second DAC 144 according to the second intermediate code Dmid2. According to the second code-to-voltage mapping relation, the second DAC 144 is capable of converting the second level-shifted code outputted by the second level shifter 143 into a corresponding reference voltage among the plurality of reference voltages Vref to serve as the second analog voltage Vout2. The second code-to-code mapping relation of the second code mapping circuit 130 and the second code-to-voltage mapping relation of the second DAC 144 may refer to related description for Table 2 above (but the invention is not limited thereto).

Figure 6:
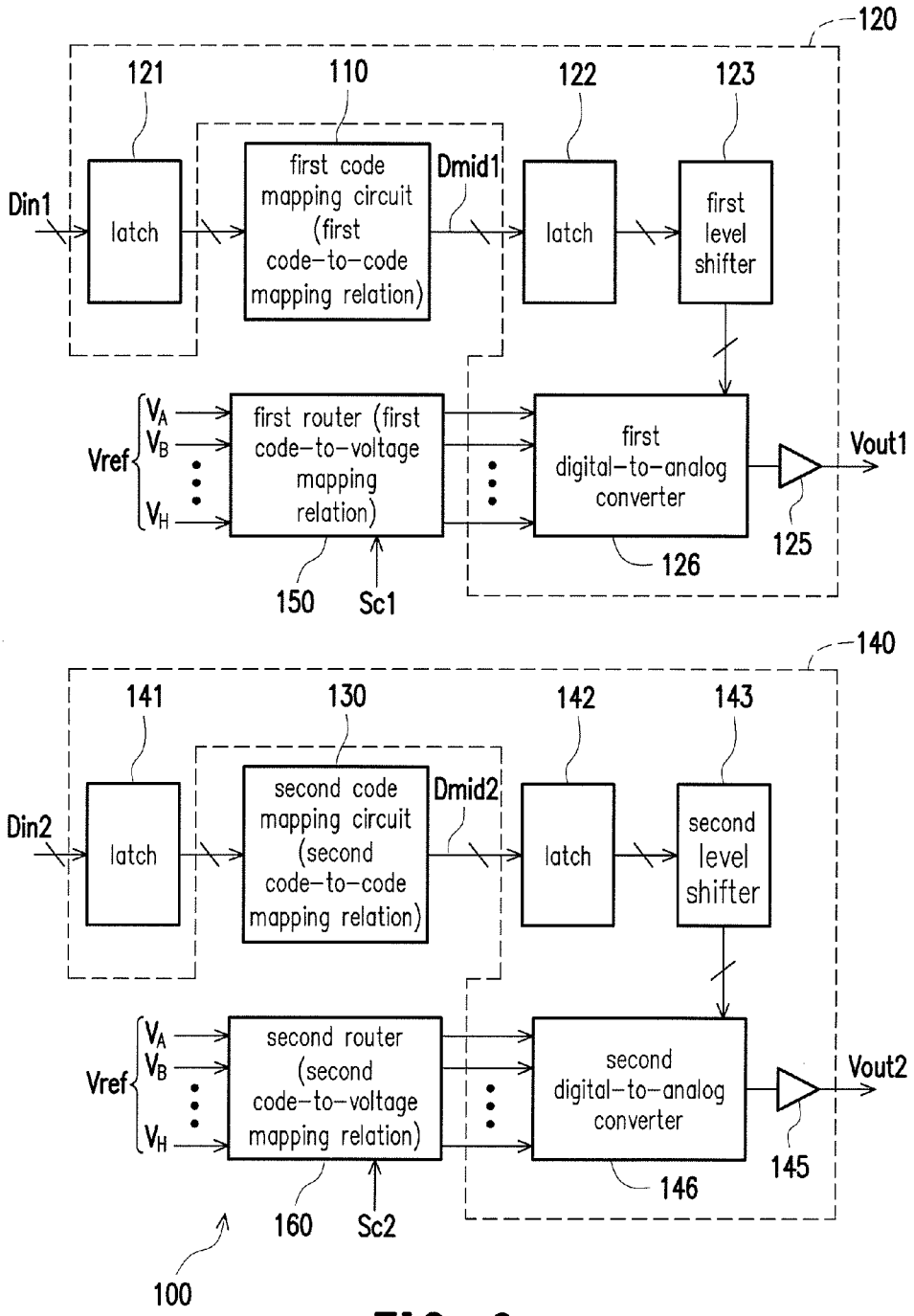
FIG. 6 is a block diagram illustrating circuitry of the driving device depicted in FIG. 1 according to yet another embodiment of the invention.

FIG. 6 is a block diagram illustrating circuitry of the driving device depicted in FIG. 1 according to yet another embodiment of the invention. Although FIG. 6 merely illustrates two of the source driving channels of the driving device 100, the rest of the source driving channels of the driving device 100 may be deduced with reference to FIG. 6, and thus related description thereof is omitted hereinafter. Referring to FIG. 6, the first source driving channel 120 includes two first latches (e.g., latches 121 and 122), a first level shifter 123, a first DAC 126 and an output buffer 125. The second source driving channel 140 includes two second latches (e.g., latches 141 and 142), a second level shifter 143, a second DAC 146 and an output buffer 145. The first source driving channel 120 and the second source driving channel 140 as depicted in FIG. 6 may refer to related description for FIG. 2 and FIG. 5, which is not repeated hereinafter. In the embodiment depicted in FIG. 6, the first code mapping circuit 110 is coupled between the latch 121 and the latch 122, and the second code mapping circuit 130 is coupled between the latch 141 and the latch 142.

The latch 121 is capable of latching the first input code Din1 in the digital data Din, and outputting the latched first input code Din1 to the first code mapping circuit 110. The first code mapping circuit 110 converts the first input code Din1 into the first intermediate code Dmid1 according to a first code-to-code mapping relation, and outputs the first intermediate code Dmid1 to the latch 122. The first code-to-code mapping relation of the first code mapping circuit 110 may refer to related description for Table 1 above (but the invention is not limited thereto). The latch 122 is capable of latching the first intermediate code Dmid1, and outputting the latched first intermediate code Dmid1 to the first level shifter 123. The first level shifter 123 generates a first level-shifted code to the first DAC 126 according to the first intermediate code Dmid1. The driving device 100 further includes a first router circuit 150. The first router circuit 150 is coupled to the first DAC 126. The first router circuit 150 generates a plurality of reference voltages Vref in a first sequence order to the first DAC 126 according to a first control signal Sc1. The first sequence order is corresponding to the first code-to-voltage mapping relation. When the first code mapping circuit 110 dynamically changes the first code-to-code mapping relation, the first router circuit 150 dynamically adjusts the first sequence order correspondingly, so as to correspondingly change the first code-to-voltage mapping relation. According to the first code-to-voltage mapping relation, the first DAC 126 is capable of converting the first level-shifted code outputted by the first level shifter 123 into a corresponding reference voltage among the plurality of reference voltages Vref to serve as the first analog voltage Vout1.

For instance, the first code-to-voltage mapping relation of the first router circuit 150 and the first DAC 126 may refer to Table 4 below (but the invention is not limited thereto). In Table 4, a plurality of reference voltage input terminals of the first router circuit 150 each receives one of voltages $V_A$, $V_B$, $V_C$, $V_D$, $V_E$, $V_F$, $V_G$ and $V_H$, respectively. The first router circuit 150 changes an arrange sequence of the voltages $V_A$, $V_B$, $V_C$, $V_D$, $V_E$, $V_F$, $V_G$ and VH according to the first control signal Sc1, and generates the reference voltages in the first sequence order (e.g., $V_A$, $V_B$, $V_C$, $V_D$, $V_H$, $V_G$, $V_F$ and $V_E$) to the first DAC 126. The first DAC 126 is capable of selecting the corresponding reference voltage from among the reference voltages in the first sequence order to serve as the first analog voltage Vout1 according to the first intermediate code Dmid1 (the first level-shifted code) outputted by the level shifter 123, as shown in Table 4. For example, when the first intermediate code Dmid1 is "100", the first DAC 126 can select the voltage $V_H$ at a fifth reference voltage input terminal thereof to serve as the first analog voltage Vout1.

TABLE 4

| the exemplary example of the first code-to-voltage mapping relation | | | |
|---|---|---|---|
| First router circuit 150 | | First DAC 126 | |
| Input | Output | First intermediate code Dmid1 | First analog voltage Vout1 |
| $V_A$ | $V_A$ | 000 | $V_A$ |
| $V_B$ | $V_B$ | 001 | $V_B$ |
| $V_C$ | $V_C$ | 010 | $V_C$ |
| $V_D$ | $V_D$ | 011 | $V_D$ |
| $V_E$ | $V_H$ | 100 | $V_H$ |
| $V_F$ | $V_G$ | 101 | $V_G$ |
| $V_G$ | $V_F$ | 110 | $V_F$ |
| $V_H$ | $V_E$ | 111 | $V_E$ |

Similarly, the latch 141 is capable of latching the second input code Din2 in the digital data Din, and outputting the latched second input code Din2 to the second code mapping circuit 130. The seconds code mapping circuit 130 converts the second input code Din2 into the second intermediate code Dmid2 according to a second code-to-code mapping relation, and outputs the second intermediate code Dmid2 to the latch 142. The second code-to-code mapping relation of the second code mapping circuit 130 may refer to related description for Table 2 above (but the invention is not limited thereto). The latches 142 is capable of latching the second intermediate code Dmid2, and outputting the latched second intermediate code Dmid2 to the second level shifter 143. The second level shifter 143 generates a second level-shifted code to the second DAC 146 according to the second intermediate code Dmid2. The driving device 100 further includes a second router circuit 160. The second router circuit 160 is coupled to the second DAC 146. The second router circuit 160 generates a plurality of reference voltages Vref in a second sequence order to the second DAC 146 according to a second control signal Sc2. The second sequence order is corresponding to the second code-to-voltage mapping relation. When the second code mapping circuit 130 dynamically changes the second code-to-code mapping relation, the second router circuit 160 dynamically adjusts the second sequence order correspondingly, so as to correspondingly change the second code-to-voltage mapping relation. According to the second code-to-voltage mapping relation, the second DAC 146 is capable of converting the second level-shifted code outputted by the second level shifter 143 into a corresponding reference voltage among the plurality of reference voltages Vref to serve as the second analog voltage Vout2.

For instance, the second code-to-voltage mapping relation of the second router circuit 160 and the second DAC 146 may refer to Table 5 below (but the invention is not limited thereto). In Table 5, a plurality of reference voltage input terminals of the second router circuit 160 each receives one of voltages $V_A$, $V_B$, $V_C$, $V_D$, $V_E$, $V_F$, $V_G$ and $V_H$, respectively. The second router circuit 160 changes an arrange sequence of the voltages $V_A$, $V_B$, $V_C$, $V_D$, $V_E$, $V_F$, $V_G$ and $V_H$ according to the second control signal Sc2, and generates the reference voltages in the second sequence order (e.g., $V_A$, $V_B$, $V_E$, $V_F$, $V_H$, $V_G$, $V_D$ and $V_C$) to the second DAC 146. The second DAC 146 is capable of selecting the corresponding reference voltage from among the reference voltages in the second sequence order to serve as the second analog voltage Vout2 according to the second intermediate code Dmid2 (the second level-shifted code) outputted by the level shifter 143, as shown in Table 5. For example, when the second intermediate code Dmid2 is "010", the second DAC 146 can select the voltage $V_E$ at a third reference voltage input terminal thereof to serve as the second analog voltage Vout2.

TABLE 5

| the exemplary example of the second code-to-voltage mapping relation | | | |
|---|---|---|---|
| Second router circuit 160 | | Second DAC 146 | |
| | | Second intermediate | |
| Input | Output | code Dmid2 | Second analog voltage Vout2 |
| $V_A$ | $V_A$ | 000 | $V_A$ |
| $V_B$ | $V_B$ | 001 | $V_B$ |
| $V_C$ | $V_E$ | 010 | $V_E$ |

TABLE 5-continued

| the exemplary example of the second code-to-voltage mapping relation | | | |
|---|---|---|---|
| Second router circuit 160 | | Second DAC 146 | |
| | | Second intermediate | |
| Input | Output | code Dmid2 | Second analog voltage Vout2 |
| $V_D$ | $V_F$ | 011 | $V_F$ |
| $V_E$ | $V_H$ | 100 | $V_H$ |
| $V_F$ | $V_G$ | 101 | $V_G$ |
| $V_G$ | $V_D$ | 110 | $V_D$ |
| $V_H$ | $V_C$ | 111 | $V_C$ |

Figure 7:
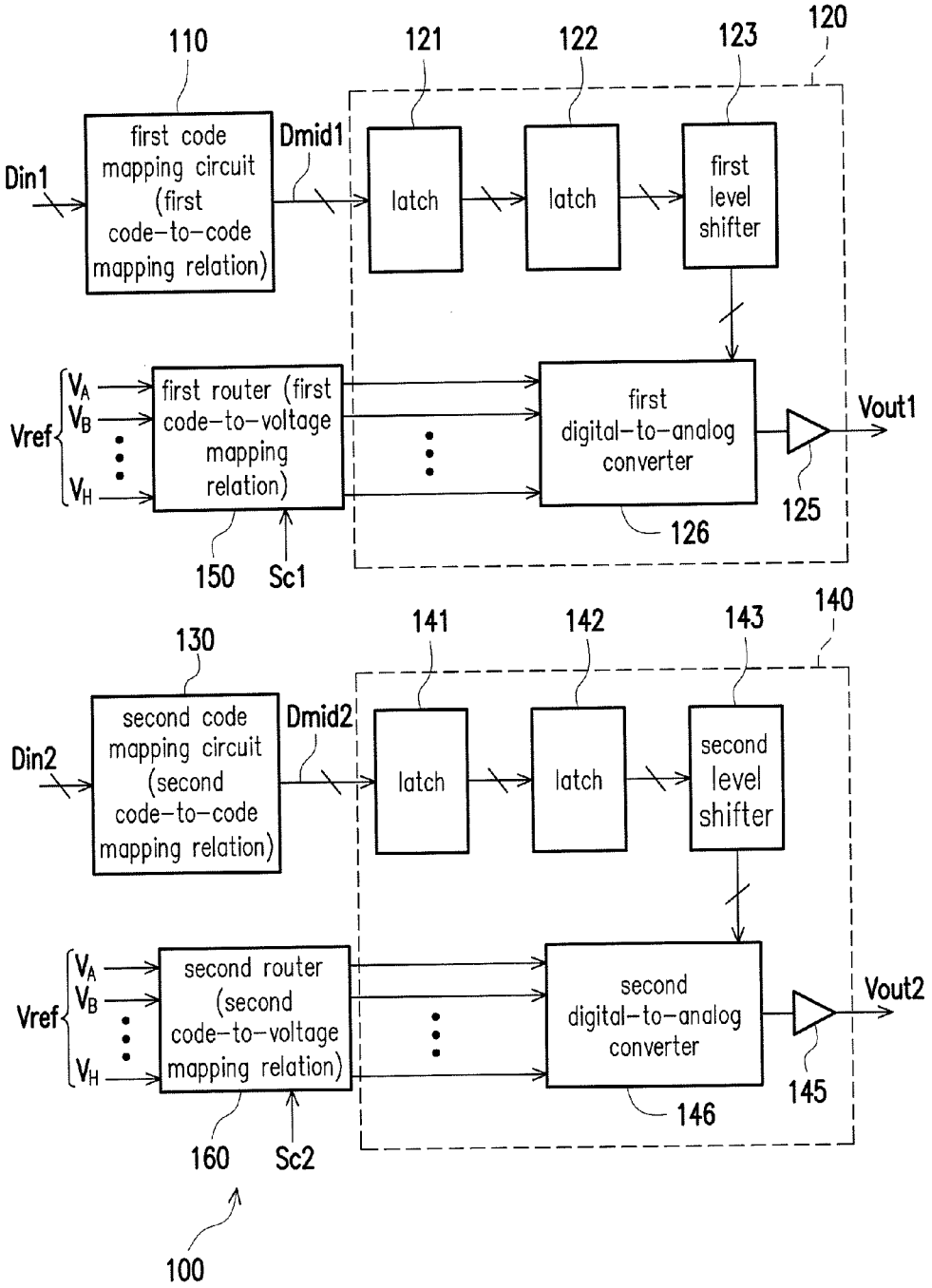
FIG. 7 is a block diagram illustrating circuitry of the driving device depicted in FIG. 1 according to still another embodiment of the invention.

FIG. 7 is a block diagram illustrating circuitry of the driving device depicted in FIG. 1 according to still another embodiment of the invention. Although FIG. 7 merely illustrates two of the source driving channels of the driving device 100, the rest of the source driving channels of the driving device 100 may be deduced with reference to FIG. 7, and thus related description thereof is omitted hereinafter. Referring to FIG. 7, the first source driving channel 120 includes a latch 121, a latch 122, a first level shifter 123, a first DAC 126 and an output buffer 125. The second source driving channel 140 includes a latch 141, a latch 142, a second level shifter 143, a second DAC 146 and an output buffer 145. The first code mapping circuit 110, the latch 121, the latch 122, the first level shifter 123, the output buffer 125, the second code mapping circuit 130, the latch 141, the latch 142, the second level shifter 143 and the output buffer 145 as depicted in FIG. 7 may refer to the related description for FIG. 2, which is not repeated hereinafter.

In the embodiments depicted in FIG. 7, the driving device 100 further includes a first router circuit 150 and a second router circuit 160. The first router circuit 150, the first DAC 126, the second router circuit 160 and the second DAC 146 as depicted in FIG. 7 may refer to related description for the first router circuit 150, the first DAC 126, the second router circuit 160 and the second DAC 146 as depicted in FIG. 6, which is not repeated hereinafter.

Figure 8:
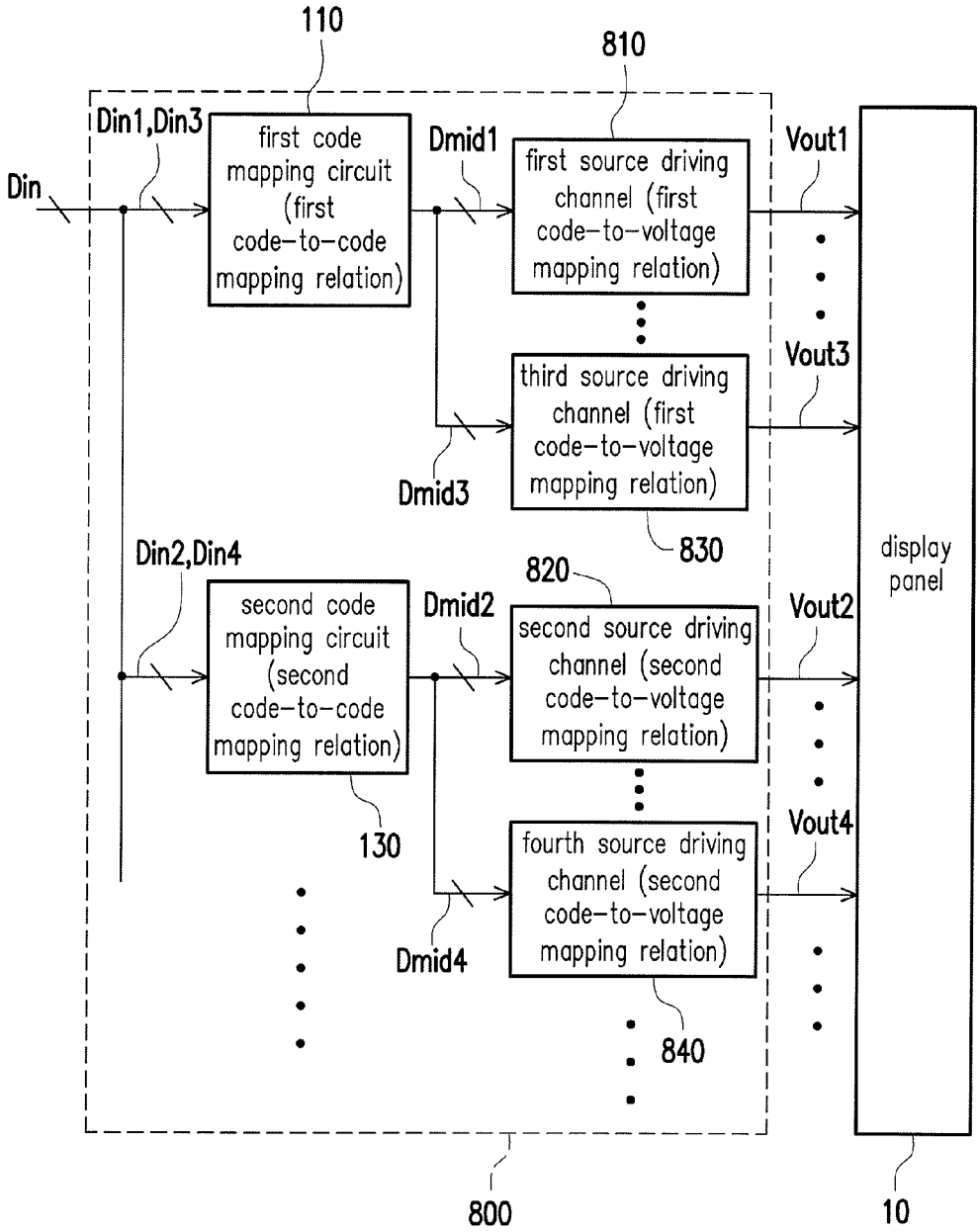
FIG. 8 is a block diagram illustrating circuitry of a driving device according to another embodiment of the invention.

FIG. 8 is a block diagram illustrating circuitry of a driving device according to another embodiment of the invention. A driving device 800 includes a plurality of code mapping circuits (e.g., a first code mapping circuit 110 and a second code mapping circuit 130) and a plurality of source driving channels (e.g., a first source driving channel 810, a second source driving channel 820, a third source driving channel 830 and a fourth source driving channel 840). The first code mapping circuit 110 and the second code mapping circuit 130 as depicted in FIG. 8 may be deduced from related description for FIG. 2 to FIG. 7, which is not repeated hereinafter.

In the embodiment depicted in FIG .8, the first code mapping circuit 110 converts a first input code Din1 in input data Din into a first intermediate code Dmid1 according to a first code-to-code mapping relation, and converts a third input code Din3 in the input data Din into a third intermediate code Dmid3 according to the first code-to-code mapping relation The first source driving channel 810 is coupled to the first code mapping circuit 110. The first source driving channel 810 receives the first intermediate code Dmid1, and converts the first intermediate code Dmid1 into a first analog voltage Vout1 according to a first code-to-voltage mapping relation. The first source driving channel 810 outputs the first analog voltage Vout1 to a data line (source line) of a display panel 10 in order to drive the display panel 10. The third source driving channel 830 is coupled to the first code mapping circuit 110. The third source driving channel 830 receives the third intermediate code Dmid3, and converts the third intermediate code Dmid3 into a third analog voltage Vout3 according to the first code-to-voltage mapping relation. The third source driving channel 830 outputs the third analog voltage Vout3 to another data line (source line) of the display panel 10 in order to drive the display panel 10. The first source driving channel 810 and the third source driving channel 830 as depicted in FIG. 8 may be deduced from related description for the first source driving channel 120 depicted in FIG. 2 to FIG. 7, which is not repeated hereinafter.

According to a second code-to-code mapping relation which is different from the first code-to-code mapping relation, the second code mapping circuit 130 converts a second input code Din2 in the input data Din into a second intermediate code Dmid2, and then convert a fourth input code Din4 in the input data Din into a fourth intermediate code Dmid4 according to the second code-to-code mapping relation. The second source driving channel 820 is coupled to the second code mapping circuit 130 in order to receive the second intermediate code Dmid2. According to a second code-to-voltage mapping relation which is different from the first code-to-voltage mapping relation, the second source driving channel 820 converts the second inteiniediate code Dmid2 into a second analog voltage Vout2. The second source driving channel 820 outputs the second analog voltage Vout2 to another data line of the display panel 10 in order to drive the display panel 10. The fourth source driving channel 840 is coupled to the second code mapping circuit 130. The fourth source driving channel 840 receives the fourth intermediate code Dmid4, and converts the fourth intermediate code Dmid4 into a fourth analog voltage Vout4 according to the second code-to-voltage mapping relation. The fourth source driving channel 840 outputs the fourth analog voltage Vout4 to another data line of the display panel 10 in order to drive the display panel 10. The second source driving channel 820 and the fourth source driving channel 840 as depicted in FIG. 8 may be deduced from related description for the second source driving channel 140 depicted in FIG. 2 to FIG. 7, which is not repeated hereinafter.

In summary, according to the embodiment depicted in FIG. 8, all the source driving channels of the driving device 800 are grouped in a plurality of groups, and each of the groups has one or more source driving channels. By providing different code-to-code mapping relations for the different groups, the driving device 800 of the present embodiment is capable of effectively reducing the average number of the transitional bits in the digital data of the source driving channels. As a result, the large number of instantaneous currents simultaneously occurred on the level shifters inside all the source driving channels may be effectively prevent, so as to achieve the effectiveness of reducing temperature and enhancing the reliability of the chip.

Lastly, it should be noted that, the above embodiments merely serve as examples in the present embodiment, the invention is not limited thereto. Despite that the invention has been described with reference to above embodiments, it will be apparent to those skilled in the art that various modifications and variations can be made to the structure of the technical content disclosed in above embodiments of the invention without departing from the scope or spirit of the invention. In view of the foregoing, it is intended that the invention cover modifications and variations of this invention provided they fall within the scope of the following claims and their equivalents.

What is claimed is:

1. A driving device, comprising:

a first code mapping circuit, converting a first input code in input data into a first intermediate code according to a first code-to-code mapping relation;

a first source driving channel, coupled to the first code mapping circuit, and the first source driving channel receiving the first intermediate code and converting the first intermediate code into a first analog voltage according to a first code-to-voltage mapping relation;

a second code mapping circuit, converting a second input code in the input data into a second intermediate code according to a second code-to-code mapping relation which is different from the first code-to-code mapping relation; and a second source driving channel, coupled to the second code mapping circuit, and the second source driving channel receiving the second intermediate code and converting the second intermediate code into a second analog voltage according to a second code-to-voltage mapping relation which is different from the first code-to-voltage mapping relation.

2. The driving device of claim 1, wherein the first source driving channel comprises:

a first level shifter, generating a first level-shifted code according to the first intermediate code; and a first digital-to-analog converter (DAC), receiving a plurality of first reference voltages, and converting the first level-shifted code into a corresponding reference voltage among the plurality of first reference voltages to serve as the first analog voltage according to the first code-to-voltage mapping relation; and the second source driving channel comprises:

a second level shifter, generating a second level-shifted code according to the second intermediate code; and a second DAC, receiving a plurality of second reference voltages, and converting the second level-shifted code into a corresponding reference voltage among the plurality of second reference voltages to serve as the second analog voltage according to the second code-to-voltage mapping relation.

3. The driving device of claim 2, wherein the first source driving channel further comprises at least two first latches, coupled between the first code mapping circuit and the first level shifter; and the second source driving channel further comprises at least two second latches, coupled between the second code mapping circuit and the second level shifter.

4. The driving device of claim 2, wherein the first source driving channel further comprises two first latches, and the first code mapping circuit being coupled between the two first latches; and the second source driving channel further comprises two second latches, and the second code mapping circuit being coupled between the two second latches.

5. The driving device of claim 2, wherein a first routing path corresponding to the first code-to-voltage mapping relation is included inside the first DAC; and a second routing path corresponding to the second code-to-voltage mapping relation is included inside the second DAC.

6. The driving device of claim 2, further comprising:

a first router circuit, coupled to the first DAC, and the first router circuit generating the plurality of first reference voltages in a first sequence order to the first DAC according to a first control signal, wherein the first sequence order is corresponding to the first code-to-voltage mapping relation; and a second router circuit, coupled to the second DAC, and the second router circuit generating the plurality of second reference voltages in a second sequence order to the second DAC according to a second control signal, wherein the second sequence order is corresponding to the second code-to-voltage mapping relation.

7. The driving device of claim 6, wherein the first code mapping circuit further dynamically changes the first code-to-code mapping relation, and the first router circuit dynamically adjusts the first sequence order correspondingly, so as to correspondingly change the first code-to-voltage mapping relation; and the second code mapping circuit further dynamically changes the second code-to-code mapping relation, and the second router circuit dynamically adjusts the second sequence order correspondingly, so as to correspondingly change the second code-to-voltage mapping relation.

8. The driving device of claim 1, wherein the first code mapping circuit further converts a third input code in the input data into a third intermediate code according to the first code-to-code mapping relation, and the driving device further comprises:

a third source driving channel, coupled to the first code mapping circuit, and the third source driving channel receiving the third intermediate code and converting the third intermediate code into a third analog voltage according to the first code-to-voltage mapping relation.

9. The driving device of claim 8, wherein the second code mapping circuit further converts a fourth input code in the input data into a fourth intermediate code according to the second code-to-code mapping relation, and the driving device further comprises:

a fourth source driving channel, coupled to the second code mapping circuit, and the fourth source driving channel receiving the fourth intermediate code and converting the fourth intermediate code into a fourth analog voltage according to the second code-to-voltage mapping relation.

* * * * *